US006199281B1

(12) United States Patent
Lee et al.

(10) Patent No.: US 6,199,281 B1
(45) Date of Patent: Mar. 13, 2001

(54) METHOD OF PREPARING A HEARTH ROLL WITH A COATING

(75) Inventors: Yuh-Wen Lee, Kaohsiung Hsien; Wei-Cheng Lih, Tainan; Wei-Jieh Chang, Yunlin Hsien; Wei-Deam Shiau, Changhua Hsien; Zhong-Ren Wu, Taichung Hsien; Tsong-Jen Yang, Taichung; I-Chung Hsu, Taipei, all of (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/448,058

(22) Filed: Nov. 23, 1999

(51) Int. Cl.[7] ..... B21D 53/00

(52) U.S. Cl. ..... 29/895.32; 29/895.21; 492/58; 427/453; 427/456

(58) Field of Search ..... 29/895.32, 895.21, 29/895.3; 492/54, 58; 427/446, 453, 454, 455, 456, 190, 191

(56) References Cited

U.S. PATENT DOCUMENTS 4,631,117 * 12/1986 Minten et al. .
5,161,306 * 11/1992 Nakahira ..... 29/895.32
5,456,946 * 10/1995 Snellman ..... 29/895.32
5,466,208 * 11/1995 Jackson et al. .

FOREIGN PATENT DOCUMENTS 60-052594 * 3/1986 (JP) .
02089592 * 3/1990 (JP) .

* cited by examiner

*Primary Examiner*—I Cuda Rosenbaum
(74) *Attorney, Agent, or Firm*—Knobbe, Martens, Olson & Bear, LLP

(57) ABSTRACT

A method of preparing a hearth roll with a coating, including: plating a metal on a ceramic powder by using electroless plating; mixing the metal-plated ceramic powder and a metal powder to form a cement powder; and thermally spraying the cement powder onto a hearth roll. Another method is: plating a metal on a ceramic powder by using electroless plating; mixing the metal-plated ceramic powder, a metal powder, and a binder to form a slurry, and subjecting the slurry to granulating and sintering to obtain a sintered powder; and thermally spraying the sintered powder onto a hearth roll.

22 Claims, No Drawings

METHOD OF PREPARING A HEARTH ROLL WITH A COATING

BACKGROUND OF THE INVENTION

1. Field of the Invention

The present invention relates to a method of preparing a hearth roll with a coating. More particularly, the present invention relates to a method of thermally spraying electroless-plated ceramic powder and metal powder simultaneously onto a hearth roll.

2. Description of the Related Arts

In the process of continuous annealing and continuous galvanization, a rolled steel strip is conveyed by means of a hearth roll. Conventionally, a hearth roll is installed in a high temperature zone (800–1200° C.), thus, in addition to having thermal oxidation resistance, the surface of a hearth roll has to retain hardness under high temperature, thereby maintaining the necessary surface roughness to produce the necessary friction to convey and avoid the slippage of a steel strip. In addition, there is also a need for a hearth roll to have excellent chemical inertness in order to prevent ferric oxide or other metal oxides of the surface of a steel strip from adhering to the surface of a hearth roll to form the buildup and cause defects on the surface of a steel strip.

An earlier technique to prevent the formation of the buildup on the surface of a hearth roll was to plate hard chromium on the surface of a hearth roll to form a hard layer. However, such hard chromium layer has the disadvantage of decreasing in hardness when the temperature is higher than 450° C. Thus, recently a new technique has been developed, in which heat-resistant alloy powder with high hardness or ceramic powder are melted, thermally sprayed, and thus adhered to the surface of a hearth roll. The alloy coating has the advantages of easy-fabrication and an excellent adhesion; however, it is restricted by insufficient hardness under high temperature. In contrast, the ceramic coating has the advantages of hardness under high temperature, heat-resistance and wear-resistance; however, due to the poor adhesion, it has the disadvantage of easy-collapse under high temperature, and thus the surface roughness cannot be maintained.

Therefore, the cement coating technique, with the advantages of both alloy and ceramic coatings, has been widely used in the treatment of a hearth roll recently. The technique used is to mix ceramic powder and metal powder first; afterward, the mixed powder was sprayed simultaneously onto the surface of a hearth roll so that this coating has the advantages of both excellent adhesion from the alloy coating and hardness under high temperature from the ceramic coating.

The technology of the cement coating is described in U.S Pat. No. 4,470,802. Niobium powder (metal powder) and inorganic material (ceramic powder) are mixed mechanically, and then the mixture is sprayed onto the surface of a hearth roll.

However, this process has the following disadvantages. During the period of storage and transportation, the metal powder tends to settle due to the different densities between metal powder and ceramic powder. Thus, when the powder for spraying is obtained by mixing the two powders mechanically, the ratio between metal powder and ceramic powder will be changed. Thus, the different densities between metal powder and ceramic powder can cause the loss of the ceramic powder during the spraying, making the hardness of the coating insufficient. Moreover, because of the different surface tensions between metal powder and ceramic powder, the melted metal powder has insufficient wettability to the ceramic powder, so that the coating will have higher porosity and lower buildup-resistance.

SUMMARY OF THE INVENTION

In view of the above problems, it is the object of the present invention to provide a hearth roll with a coating of high hardness, low porosity and high buildup-resistance.

Another object of the present invention is to provide a hearth roll with a coating, in which the ceramic content can be controlled precisely.

In order to accomplish the aforementioned objects and advantages a method of preparing a hearth roll with a coating according to the present invention, comprises the steps of: (a) plating a metal on a ceramic powder by using electroless plating; (b) mixing the metal-plated ceramic powder and a metal powder to form a cermet powder; and (c) thermally spraying the cermet powder onto a hearth roll.

Another method of preparing a hearth roll with a coating according to the present invention comprises the steps of: (a) plating a metal on a ceramic powder by using electroless plating; (b) mixing the metal-plated ceramic powder, a metal powder, and a binder to form a slurry, and subjecting the slurry to granulating and sintering to obtain a sintered powder; and (c) thermally spraying the sintered powder onto a hearth roll.

Other objects, features, and advantages of the present invention will become apparent from the following detailed description.

DETAILED DESCRIPTION OF THE INVENTION

The method of preparing a hearth roll with a coating according a first embodiment of the present invention is to thermally spray a ceramic powder plated with a metal using electroless plating and a metal powder onto the hearth roll.

The ceramic powder used herein can be oxides, carbides, nitrides, or mixtures thereof. The embodied examples include alumina ($Al_2O_3$), yttria ($Y_2O_3$), zirconia ($ZrO_2$) tungsten carbide (WC), and chromium carbide ($Cr_2C_3$) etc. The major reason why the ceramic powder is plated with metal is to increase the density of the ceramic powder, and thus the metal type used herein is not to be restricted. However, cobalt and nickel are preferred. The electroless-plating solution can be adjusted according to the metal which is plated on the ceramic powder; for example, a solution containing cobalt when the cobalt is the metal we want to plate on.

According to the present embodiment, the powder used for thermally spraying is the cermet powder obtained by mixing the ceramic powder plated with metal and the metal powder. The resulting cermet powder can be sprayed onto a hearth roll directly.

In a second embodiment of the present invention, in order to increase the adhesion of the electroless metal-plated ceramic powder to the metal powder, the cermet powder (electroless metal-plated ceramic powder and metal powder) is mixed with a binder to form a slurry, followed by granulating and sintering to obtain a sintered powder. Then, the sintered powder is thermally sprayed onto a hearth roll. The process of granulating is to dry the above-described slurry at 40~80° C., and then shatter for granulating. The condition of sintering is at 900~1100° C. under vacuum. By the process of mixing the binder, granulating ,and sintering, there is provided a powerful bond strength between the ceramic and metal powders, thus makes preventing ceramic powder from separating from the metal powder during the spraying process.

The metal powder used to mix with the metal-plated ceramic powder is selected from the group consisting of cobalt powder, cobalt alloy powder, nickel powder, nickel alloy powder, iron powder, iron alloy powder, niobium powder, niobium alloy powder, and mixtures thereof. The cobalt alloy powder and nickel alloy powder are preferred; for example, cobalt-chromium alloy powder or nickel-chromium alloy powder.

The thermally spraying of the sintered powder or the cermet powder onto a hearth roll, according to the present invention, can be conducted by flame spraying, plasma spraying or high velocity oxygen fuel spraying. During the process of spraying, the metal powder can be melted sufficiently, and the ceramic powder can be still maintained as solid and dispersed in the metal substrate evenly, so that the object of strengthening the coating can be accomplished.

The main feature of the present invention is to replace the conventional ceramic powder with ceramic powder plated with metal by using electroless plating. Due to the metal plating, the ceramic powder of the present invention has a higher density than the conventional ceramic powder. Thus, during the period of storage and transportation, the powders for spraying (cermet powder or sintered powder) of the present invention to not suffer from the settling of metal powder due to the different densities between the metal powder and the ceramic powder.

During the process of spraying, both the electroless-plated metal layer on the surface of the ceramic powder, and the metal powder will be melted. Therefore, the ceramic powder can be wetted effectively with the metal powder by the melting of the electroless-plated metal layer, and thus the ceramic powder can be adhered to the metal powder very well. Consequently, the ceramic content sprayed onto a hearth roll can be controlled precisely, and the resulting coating has higher hardness, lower porosity, and better buildup-resistance.

Without intending to limit it in any manner, the present invention will be further illustrated by the following examples.

EXAMPLE 1

The reagent for sensitization: 70 g/L of $SnCl_2$ was added to 100 ml of HCl/L to form an aqueous solution.

The reagent for activation: 1.0 g/L of $PdCl_2$ was added to 20 ml of HCl/L to form an aqueous solution.

The reagent of cobalt for electroless plating (pH 8.0~9.5): To 1 liter of water were added following components:

15~30 g/L of cobalt sulfate

20~40 g/L of sodium hypophosphite

30~90 g/L of sodium citrate

30~60 g/L of ammonium chloride

To the reagent for sensitization described above was added aluminum oxide powder. The solution was stirred for 1 minute, and then filtered, washed, and re-filtered. Then the filtrate was poured into a tank containing the activating reagent. Afterward, the solution was stirred for 1~2 minutes with a magnetic stirrer, and then filtered, washed, re-filtered, and dried at 100° C. for 6~8 hours. The aluminum oxide powder which had been sensitized and activated was poured into a tank containing the above-mentioned cobalt-plating reagent and stirred evenly. The plating was proceeded at 85~90° C. for 1~3 hours, and the thickness of the electroless-plated metal was controlled based on the desired weight increase. Finally, the aluminum oxide powder with the electroless-plated cobalt was taken out, then washed and filtered under high pressure, and dried for further use.

15 g of the electroless cobalt-plated aluminum oxide powder and 100 g of CoCrAlY metal powder were mixed in a ball mill at 200 rpm for 2 hours, and then screened through a mesh to obtain the cermet powder.

The surface of the hearth roll article was treated with grinding and sand blasting to obtain the desired roughness. Then the cermet powder was sprayed onto the surface of the hearth roll article by high velocity oxygen fuel spraying.

The properties of the surface of the hearth roll article was analyzed as follows: The micro-hardness Hv300 reached 980; the porosity was less than 1%; the binding strength was 11,000 psi; and the thermal impact strength (500~1,000° C./tempered with water) reached 12 cycles.

The following was the anti-buildup test of the surface coating of the hearth roll article. Ferric oxide powder was sprinkled onto the coating of the hearth roll and pressurized (loading 20 kg) at 900° C. It was found that the area of the coating was covered with ferric oxide was 8%. Afterward, the ferric oxide was brushed off using a brush. It was found that the ferric oxide was brushed off thoroughly without residue. The roughness (Ra) of the surface of this coating was 0.6 micrometer.

COMPARITIVE EXAMPLE 1

15 g of the aluminum oxide powder (without electroless-plated cobalt) and 100 g of CoCrAlY metal powder were mixed in a ball mill at 200 rpm for 2 hours, and then screened through a mesh to obtain the cermet powder.

The surface of the hearth roll article was treated with grinding and sand blasting to obtain the desired roughness. Then the above-described cermet powder was sprayed onto the surface of the hearth roll article by high velocity oxygen fuel spraying.

The following was the anti-buildup test of the surface coating of the hearth roll article. Ferric oxide powder was sprinkled onto the coating of the hearth roll and pressurized (loading 20 kg) at 900° C. It was found that the area of the coating covered with ferric oxide was 20%. Afterward, the ferric oxide was brushed off by using a brush. It was found that the ferric oxide was not brushed off thoroughly, and the area of the coating still covered with ferric oxide was 5%. The roughness (Ra) of the surface of this coating was 1.8 micrometer.

According to the data of the roughness of the surface described above, the coating of the hearth roll obtained from treatment with electroless-plated cobalt has better buildup-resistance than the one obtained without treatment, and has less ferric oxide powder adhered onto the surface, so that the coating of the hearth roll obtained from the treatment with electroless-plated cobalt possesses a low surface roughness.

While the invention has been particularly shown and described with the reference to the preferred embodiment thereof, it will be understood by those skilled in the art that various changes in form and details may be made without departing from the spirit and scope of the invention.

What is claimed is:

1. A method of preparing a hearth roll with a coating, comprising:

(a) plating a first metal on a ceramic powder by using electroless plating in a manner such that said metal-plated ceramic powder has substantially the same density as a second metal powder;

(b) mixing said metal-plated ceramic powder and said second metal powder to form a cermet powder wherein said metal-plated ceramic powder has substantially the same density as said second metal powder so that said second metal powder is inhibited from settling after mixing;

(c) thermally spraying said cermet powder onto said hearth roll.

2. The method as claimed in claim 1, wherein said ceramic powder is made of a material selected from the group consisting of oxides, carbides, nitrides, and mixtures thereof.

3. The method as claimed in claim 1, wherein said metal which is plated on said ceramic powder in step (a) is nickel.

4. The method as claimed in claim 3, wherein said metal which is plated on said ceramic powder in step (a) is cobalt.

5. The method as claimed in claim 1, wherein said metal powder used in step (b) is selected from the group consisting of cobalt powder, cobalt alloy powder, nickel powder, nickel alloy powder, iron powder, iron alloy powder, niobium powder, niobium alloy powder, and mixtures thereof.

6. The method as claimed in claim 5, wherein said metal powder used in step (b) is cobalt alloy powder.

7. The method as claimed in claim 6, wherein said metal powder in step (b) is cobalt-chromium alloy powder.

8. The method as claimed in claim 5, wherein said metal powder used in step (b) is nickel alloy powder.

9. The method as claimed in claim 8, wherein said metal powder used in step (b) is nickel-chromium alloy powder.

10. The method as claimed in claim 1, wherein the thermally spraying in step (c) is conducted by flame spraying, plasma spraying or high velocity oxygen fuel spraying.

11. A method of preparing a hearth roll with a coating, comprising:

(a) plating a first metal on a ceramic powder by using electroless plating in a manner such that said metal-plated ceramic powder has substantially the same density as a second metal powder;

(b) mixing said metal-plated ceramic powder, a second metal powder, and a binder to form a slurry, and subjecting the slurry to granulating and sintering to obtain a sintered powder; and (c) thermally spraying said sintered powder onto said hearth roll.

12. The method as claimed in claim 11, wherein said ceramic powder is made of a material selected from the group consisting of oxides, carbides, nitrides, and mixtures thereof.

13. The method as claimed in claim 11, wherein said metal which is plated on said ceramic powder in step (a) is cobalt or nickel.

14. The method as claimed in claim 13, wherein said metal which is plated on said ceramic powder in step (a) is cobalt.

15. The method as claimed in claim 11, wherein said metal powder used in step (b) is selected from the group consisting of cobalt powder, cobalt alloy powder, nickel powder, nickel alloy powder, iron powder, iron alloy powder, niobium powder, niobium alloy powder, and mixtures thereof.

16. The method as claimed in claim 15, wherein said metal powder used in step (b) is cobalt alloy powder.

17. The method as claimed in claim 16, wherein said metal powder used in step (b) is cobalt-chromium alloy powder.

18. The method as claimed in claim 15, wherein said metal powder used in step (b) is nickel alloy powder.

19. The method as claimed in claim 18, wherein said metal powder used in step (b) is nickel-chromium alloy powder.

20. The method as claimed in claim 11, wherein the thermally spraying in step (c) is conducted by flame spraying.

21. The method as claimed in claim 11, wherein the thermally spraying in step (c) is conducted by plasma spraying.

22. The method as claimed in claim 11, wherein the thermally spraying in step (c) is conducted by high velocity oxygen fuel spraying.

* * * * *